United States Patent [19]

Iida

[11] Patent Number: 4,729,800

[45] **Date of Patent: * Mar. 8, 1988**

[54] METHOD FOR COOLING STEEL STRIP

[75] Inventor: Sachihiro Iida, Kurashiki, Japan

[73] Assignee: Kawasaki Steel Corporation, Kobe, Japan

[ * ] Notice: The portion of the term of this patent subsequent to Dec. 15, 2004 has been disclaimed.

[21] Appl. No.: 842,137

[22] Filed: Mar. 20, 1986

[30] Foreign Application Priority Data

Mar. 22, 1985 [JP] Japan ..... 60-56094

[51] Int. Cl.[4] ..... C21D 11/00

[52] U.S. Cl. ..... 148/128; 148/156

[58] Field of Search ..... 148/128, 143, 153, 155, 148/156

[56] References Cited

U.S. PATENT DOCUMENTS 4,440,583 4/1984 Ikegami et al. ..... 148/128

FOREIGN PATENT DOCUMENTS 5115 5/1966 Australia .

12270 3/1976 Australia .

86331 8/1983 European Pat. Off. ..... 266/112

*Primary Examiner*—Christopher W. Brody

*Attorney, Agent, or Firm*—Balogh, Osann, Kramer, Dvorak, Genova & Traub

[57] ABSTRACT

Disclosed is an improvement of final cooling of the steel strip by immersing in cooling water, which strip has been cooled through a cooling zone in a continuous heat treating line. The improvement is achieved by injecting cooling water to the surface of the immersed strip to rapidly cool the strip to a predetermined temperature until the strip reaches the first sink-roll and resulted in that any dirt adhesion on the surface of the strip caused by contacting with the first sink-roll is prevented without increment of cooling cost.

2 Claims, 8 Drawing Figures

METHOD FOR COOLING STEEL STRIP

BACKGROUND OF THE INVENTION

1. Field of the Invention

The present invention relates to an improvement of cooling of a steel strip which has been cooled through a cooling zone in a continuous heat treating line, in particular, of final cooling of the strip by immersing in cooling water in a cooling tank.

2. Related Art Statement

There has been heretofore employed such method of cooling the steel strip by continuously passing through cooling water in a cooling tank for finally cooling the strip in the continuous heat treating line such as a continuous annealing line.

The cooling tank used for cooling the steel strip is provided with a sensor for detecting temperature of cooling water, a pump for supplying cooling water and a temperature controller and arranged such that the strip is cooled to a predetermined temperature during immersing in the cooling water in the cooling tank, while the cooling water is heated by taking the heat energy of the strip so as to be recovered in the form of hot water. Such steel strip cooling method is described, for example, in Japanese Patent Application Publication No. 11,933/57.

There has been however known that when the steel strip having a high temperature is cooled by immersing in cooling water in the cooling tank, the surface of the steel strip is often dirtied with foreign substances such as dirty suspensions or the like in the cooling water.

Furthermore, it has been known that the tendency of dirt adhesion on the surface of the steel strip becomes higher as in particular the temperature of the steel strip at the inlet of the cooling tank is higher and the amount of steel strip to be cooled in the cooling tank is greater.

It has been found that the surface of the steel strip is dirtied as a result in that in case of the steel strip still having a high temperature at the inlet of the cooling tank after cooling through the cooling zone in the heat treating line, the strip can not be sufficiently cooled with the cooling water in the cooling tank by the time of contacting with a first sink-roll so that a water film interposed between the surface of the sink-roll and the surface of the strip which is wound around the sink-roll is evaporated by the heat of the strip having a high temperature to deposit dirty suspensions included in the water on the surface of the strip.

Accordingly, in order to reduce the temperature of the steel strip at the time of winding the strip around the sink-roll, some methods have been proposed such that the steel strip is sufficiently cooled through the cooling zone of the heat treating line to fall the temperature of the strip at the inlet of the cooling tank or the cooling tank is made larger to increased the distance from the surface of cooling water to the sink-roll so as to cool the strip sufficiently with cooling water until the strip reaches the first sink-roll.

Such methods however have disadvantages that in case of reducing the temperature of the steel strip at the inlet of the cooling tank, not only the heat energy of the strip can not be recovered by the cooling water, but also the electric opower consumed in cooling the strip through the cooling zone arranged before the cooling tank is increased and in case of using the larger cooling tank, the cost of equipment becomes higher.

An object of the present invention is to provide a method and an apparatus of finally cooling a steel strip capable of preventing dirts from adhering to the surface of the strip without the above mentioned disadvantages.

Another object of the invention is to provide a method and an apparatus of cooling a steel strip capable of using a smaller cooling tank.

A further object of the present invention is to provide a method and an apparatus of effectively cooling a steel strip having a higher temperature at the inlet of the cooling tank to substantially reduce the power consumed in cooling the steel strip in the cooling zone of the continuous heat treating line.

According to an aspect of the present invention, a method of cooling a steel strip which has been cooled through a cooling zone in a continuous heat treating line comprises steps of immersing the strip in cooling water through around one or more sink-rolls in a cooling tank and injecting cooling water jets to the strip from injection nozzles arranged in the cooling water until the immersed strip reach the first one of the sink-rolls, thereby to cool the strip to a temperature for preventing evaporation of a water film interposed between the surface of the first sink-roll and the surface of the strip wound around the first sink-roll.

In a preferable embodiment of the invention, the injection of water jets from the injection nozzles may be controlled in accordance with the following formula:

$$l \geqq \frac{\rho \cdot Cp \cdot v \cdot d}{2\alpha} \cdot \ln\left(\frac{Ts - Tw}{120 - Tw}\right)$$

here, l is the length of the portion of a steel strip cooled by water jets injected from injection nozzles (m)

Ts is the temperature of the steel strip at the inlet of the cooling tank (°C.)

Tw is the temperature of cooling water (°C.)

Cp is the specific heat of the steel strip (Kcal/kg°C.)

v is the feed speed of the steel strip (m/hr)

d is the thickness of the steel strip (m)

$\alpha$ is the coefficient of heat transfer (8,500~10,500 Kcal/m$^2$hr°C.)

$\rho$ is the density of the steel strip (kg/m$^3$)

According to another aspect of the present invention, an apparatus for cooling a steel strip which has been cooled through a cooling zone in a continuous heat treating line comprises a cooling tank containing cooling water, one or more sink-rolls arranged in the cooling water to guide the steel strip in the cooling tank, a guide roll provided at the inlet of the cooling tank for guiding the steel strip from the outlet of the cooling zone to the first one of the sink-rolls in the cooling water, a plurality of injection nozzles arranged along a passage of the steel strip in the cooling water to inject cooling water jets against the surfaces of the steel strip over the distance from the surface of the cooling water to the first sink-roll and means for supplying cooling water to the injection nozzles.

In a preferable embodiment of the invention, the apparatus further comprises a controller for controlling the temperature of the cooling water (Tw) and/or the steel strip (Ts) at the inlet of the cooling tank in accordance with the following formula:

$$l \geqq \frac{\rho \cdot Cp \cdot v \cdot d}{2\alpha} \cdot \ln\left(\frac{Ts - Tw}{120 - Tw}\right).$$

BRIEF DESCRIPTION OF THE DRAWINGS

Further objects and advantages of the present invention will appear more fully as the following description of illustrative embodiments proceeds in view of the drawings, in which.

DESCRIPTION OF THE PREFERRED EMBODIMENTS

Figure 1:
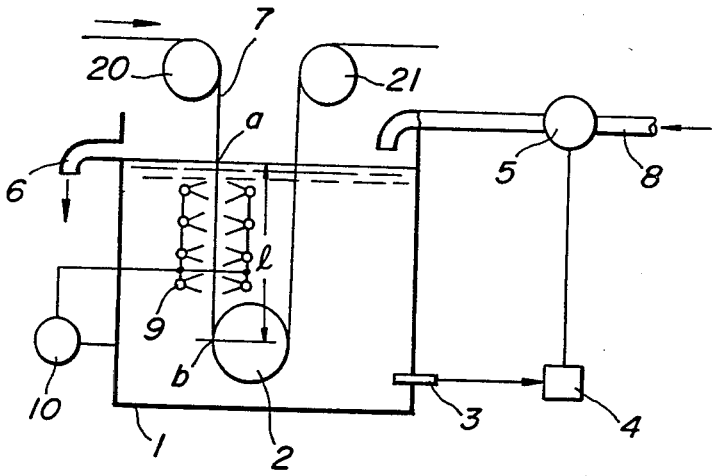
FIG. 1 is a diagrammatic view of an embodiment of the invention.

FIG. 1 shows an embodiment of an apparatus for cooling the steel strip according to the invention. In FIG. 1, a cooling water tank 1 is provided with a sink-roll 2 arranged in the cooling water to guide a steel strip 7 passing through the cooling water from an inlet guide roll 20 at the inlet of the cooling tank to an outlet guide roll 21.

There is a sensor 3 on the wall of the cooling tank 1 for detecting the temperature of the cooling water. The sensor 3 is connected to a controller 4 for controlling the temperature of the cooling water, which controller supplies an output signal to a pump 5 when the temperature of the cooling water exceeds a predetermined temperature to supply cooling water to the cooling tank 1 through a cooling water supply pipe 8 while to overflow hot water from the cooling tank through an overflow pipe 6.

In the water tank 1, a plurality of injection nozzles 9 are arranged along a passage of the steel strip between the surface of the cooling water and the sink-roll 2 to inject cooling water jets against the surfaces of the steel strip in the cooling water. The injection nozzles 9 are connected to a pump 10 provided at a supply pipe connected for circulating the cooling water in the cooling tank 1.

In order to recognize cooling conditions in case of cooling steel strip 7 by immersing in the cooling water in a tank 1, the following experiments are conducted.

Each of steel strips having different thickness from each other is provided with a thermocouple and heated at a temperature on the order of 200° to 300° C. and then immersed in the cooling water in the tank 1. Table 1 shows results obtained in case of cooling by simply immersing the heated steel strips in the cooling water in the tank and Table 2 shows results obtained in case of cooling by injecting cooling water jets to the immersed steel strips from injection nozzles arranged in the cooling water.

TABLE 1

| Thickness of steel strip (mm) | Temperature of steel strip (°C.) | Temperature of cooling water (°C.) | Coefficient of heat transfer $\alpha$ $\left(\frac{\text{Kcal}}{\text{m}^2\text{ hr °C.}}\right)$ |
|---|---|---|---|
| 0.5 | 200 | 80 | 4,800 |
| | 250 | 80 | 5,300 |
| 1.0 | 200 | 75 | 5,450 |
| | 200 | 85 | 4,850 |
| 1.5 | 300 | 90 | 5,050 |
| | 250 | 85 | 5,100 |
| | 200 | 85 | 4,950 |
| | | mean coefficient of heat transfer $\alpha_1$ | 5,000 |

TABLE 2

| Thickness of steel strip (mm) | Temperature of steel strip (°C.) | Temperature of cooling water (°C.) | Coefficient of heat transfer $\alpha$ $\left(\frac{\text{Kcal}}{\text{m}^2\text{ hr °C.}}\right)$ |
|---|---|---|---|
| 0.5 | 200 | 80 | 10,100 |
| | 250 | 75 | 9,700 |
| 1.0 | 200 | 80 | 8,500 |
| | 200 | 90 | 8,300 |
| 1.5 | 300 | 85 | 9,800 |
| | 250 | 80 | 10,500 |
| | 200 | 85 | 9,600 |
| | | mean coefficient of heat transfer $\alpha_2$ | 9,500 |

It will be seen from the Table 1 and Table 2 that in case of cooling by simply immersing in the cooling water in the tank, a mean coefficient of heat transfer $\rho_1$ becomes about 5,000 (Kcal/m$^2$hr°C.) and in case of cooling by use of immersed injection nozzles, a mean coefficient of heat transfer $\rho_2$ becomes about 9,500 (Kcal/m$^2$hr°C.) irrespective of thickness of the steel strips and the temperature of the cooling water.

It will be seen from the above described results that the case of cooling by injecting cooling water jets to the immersed steel strip can significantly improve the coefficiency of heat transfer as compared with the case of cooling by simply immersing in the cooling water.

Accordingly, when the steel strip 7 having a high temperature is cooled by immersing in the cooling water in the tank 1, the steel strip can be quickly cooled by injecting cooling water jets to the steel strip through immersed injection nozzles.

The cooling water to be injected through the immersed injection nozzle 9 may be preferably controlled to satisfy the following conditions.

Figure 2:
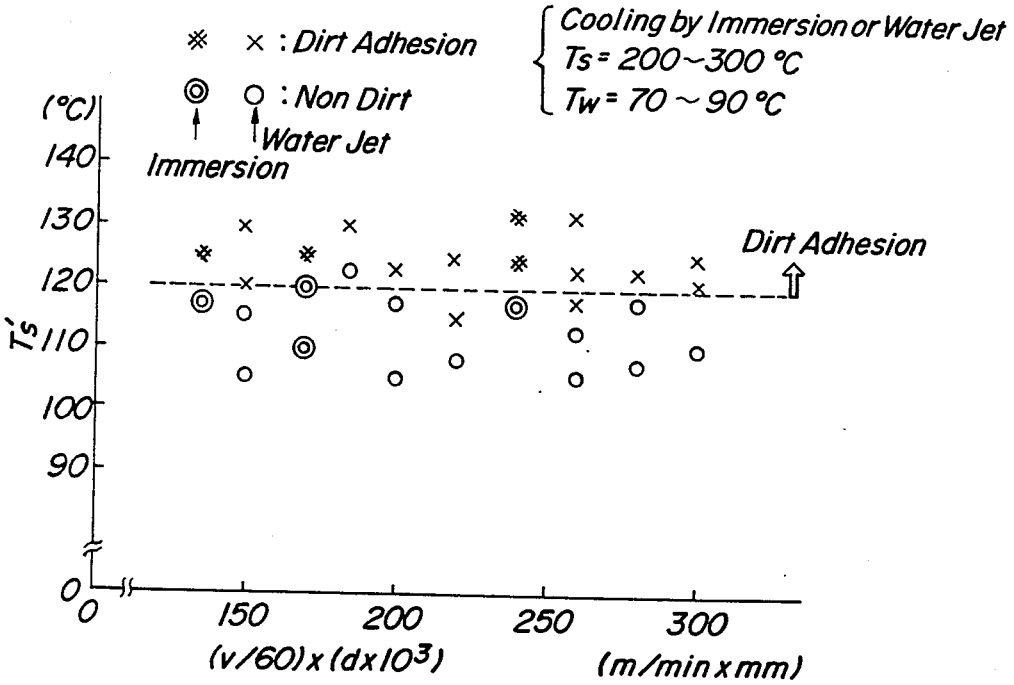
FIG. 2 is a graph showing a condition of dirt adhesion.

FIG. 2 is a graph showing the state of dirts adhered to the surface of the steel strip which is immersed at an inlet temperature Ts within 200° to 300° C. in the cooling water having a temperature Tw within 70° to 90° C. It will be seen from the graph that the dirts are adhered to the surface of the strip when the strip having a temperature Ts' at or higher than about 120° C. contacts the first sink-roll irrespective of the product of the speed of the steel strip (v/60) and the thickness of the steel strip ($d \times 10^3$). The temperature Ts' of the steel strip when the later reaches the first sink-roll 2 is represented by the following formula.

$$Ts' = Tw + (Ts - Tw)\exp\left\{\frac{2 \cdot \alpha \cdot l}{\rho \cdot Cp \cdot v \cdot d}\right\} \quad (1)$$

here,

Ts is the inlet temperature of a steel strip (°C.)

Ts' is the temperature of the steel strip when the later reaches the first sink-roll (°C.)

Tw is the temperature of cooling water (°C.)

Cp is the specific heat of the steel strip (Kcal/kg°C.)

l is the length of the portion of the steel strip cooled by the water jets injected from the injection nozzles (m)

v is the speed of the steel strip (m/hr)

d is the thickness of the steel strip (m)

$\rho$ is the density of the steel strip (kg/m$^3$)

$\alpha$ is the coefficient of heat transfer (8,500~10,500 Kcal/m$^2$hr°C.)

Since the dirts adhesion on the surface of the steel strip can be prevented by controlling the cooling temperature of the steel strip so as to satisfy a condition of $Ts' \leqq 120°$ C.

The formula (1) can be written as follows:

$$120° \text{ C.} \geqq Tw + (Ts - Tw) \cdot \exp\left\{\frac{2 \cdot \alpha \cdot l}{\rho \cdot Cp \cdot v \cdot d}\right\} \quad (2)$$

The formula (2) can be rewritten as follows:

$$l \geqq \frac{\rho \cdot Cp \cdot v \cdot d}{2\alpha} \ln\left(\frac{Ts - Tw}{120 - Tw}\right) \quad (3)$$

As the result of the experiments, it is found that the mean coefficient heat transfer $\alpha$ is 95,000 (Kcal/m$^2$hr°C.) and the density of the steel strip is 7,850. These values are substituted in the formula (3) and the following formula is given.

$$l \geqq \frac{7{,}850 \cdot Cp \cdot v \cdot d}{19{,}000} \ln\left(\frac{Ts - Tw}{120 - Tw}\right) \quad (4)$$

Accordingly, the cooling of the steel strip is controlled so as to satisfy the formula (4) by selecting the temperature of cooling water Tw°C. and the inlet temperature of the steel strip Ts in correspond to the product of the speed of the steel strip (v) and the thickness of the steel strip (d).

The flow rate (w) of the cooling water jets injected through the injection nozzles 9 is more than 1 m$^3$/min.m$^2$ and the injection pressure is 3 to 5 kg/m$^2$.

Figure 3:
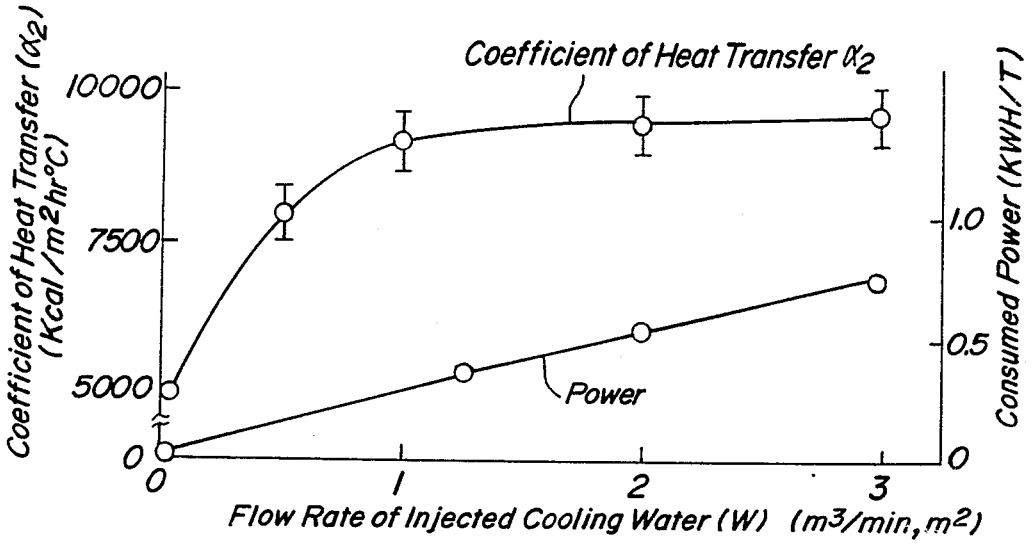
FIG. 3 is a graph showing the relation between the coefficient of heat transfer and the follow rate of the injected cooling water.

FIG. 3 is a graph showing the relation between the injection flow rate (w) and the coefficient of heat transfer ($\alpha_2$). It will be seen from the graph that the coefficient of heat transfer ($\alpha_2$) can be increased on the order of 9,000 to 10,000 Kcal/m$^2$hr°C. when the injection flow rate (w) is increased to one or more m$^3$/min.m$^2$. However, even if the injection flow rate is further increased, the coefficient of heat transfer does not substantially exceed the above value, while the power consumed in injecting the cooling water is increased so that any remarkable effect could not be expected. It is therefore desirable that the injection flow rate (w) is controlled in a range of 1 to 2 m$^3$/min.m$^2$.

It will be described some embodiments of controlling for cooling a steel strip.

Figure 4:
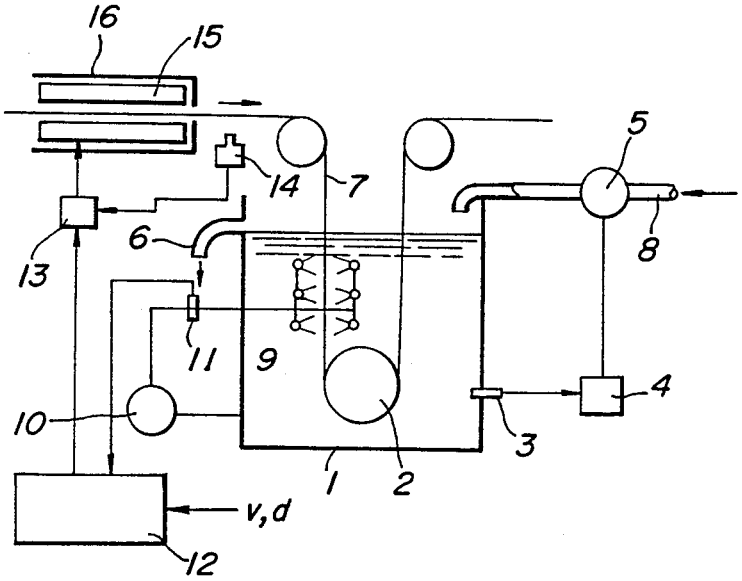
FIGS. 4, 5 and 6 are diagrammatic views of another embodiments of the invention.

FIG. 4 shows an embodiment for cooling the steel strip 7 by controlling cooling water injected from the injection nozzles 9. A temperature of the cooling water (Tw) to be injected from immersed injection nozzles 9 in a cooling tank 1 is detected by means of a temperature sensor 11. The detected temperature (Tw) of cooling water is used together with the predetermined speed (v) and thickness (d) of steel strip to operate a central processing unit 12 according to the above formula (4) to determine a temperature of steel strip (Ts) at the inlet of the cooling tank. This calculated inlet temperature of steel strip is transmitted to a temperature controller 13 and compared with an actual inlet temperature of steel strip detected by means of a steel strip temperature sensor 14. An output signal from the temperature controller 13 is used to control a cooling zone 16 so as to limit the upper limit of the actual inlet temperature of steel strip in respect to the calculated inlet temperature.

Figure 5:
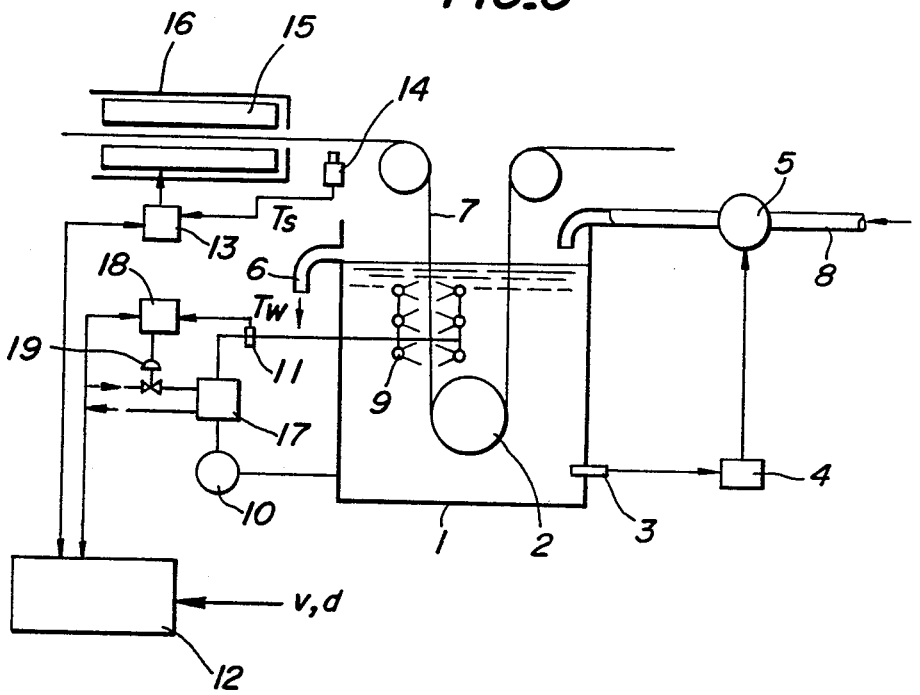

FIG. 5 shows an embodiment for controlling a temperature (Tw) of cooling water to be injected from the injection nozzles 9. In this embodiment, there is arranged a heat exchanger 17 at the discharge side of the immersed injection pump 10 and a regulating valve 19 for controlling a flow rate of cooling water supplied to the heat exchanger 17. In this case, the inlet temperature of steel strip (Ts) and/or the temperature of cooling water (Tw) is determined and controlled by the central processing unit 12 which is operated according to the above formula (4) with the predetermined speed (v) and thickness (d) of the steel strip.

Figure 6:
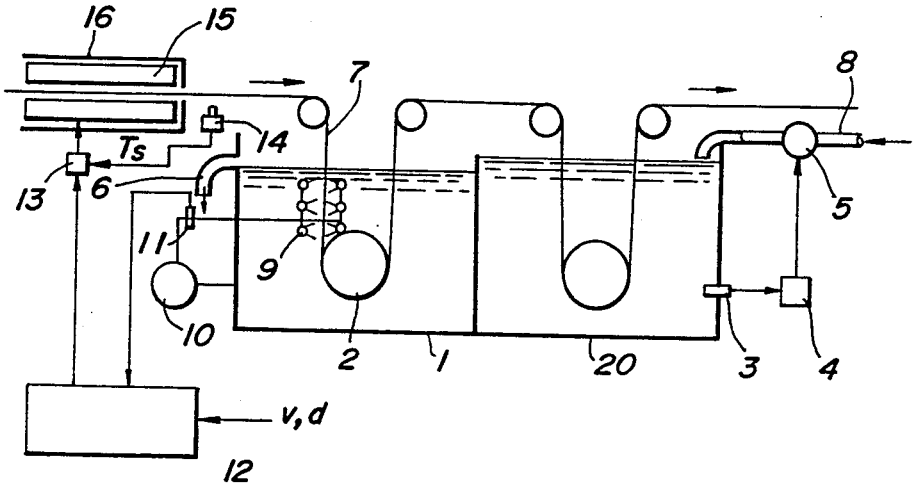

FIG. 6 shows another embodiment comprising two cooling tanks 1 and 20. In this embodiment, a temperature of cooling water in the second cooling tank 20 is controlled such that a target temperature is obtained by passing the steel strip 7 through both of the first cooling tank 1 and the second cooling tank 20. The cooling water in the second cooling tank 20 overflows into the first cooling tank 1 and the water in the tank 1 is overflowed through a discharge pipe 6 to be recovered as hot water.

EXAMPLE

It will be described a typical example of the invention referring to the embodiment shown in FIG. 4. A steel strip having a thickness of 0.5 to 1.5 mm and a width of 900 to 1,400 mm was finally cooled by injecting cooling water jets from the injection nozzles arranged in the cooling water. The temperature of the cooling water (Tw) was controlled at 80° C. and the length of the steel strip subjected to the cooling water jets (l) was 1.2 meters. The speed of steel strip (v/60) m/min multiplied by the strip thickness ($d \times 10^3$) mm was controlled to two hundred and fifty. The temperature of the steel strip was reduced through the cooling zone 16 from 350° C. to 270° C. at the inlet of the cooling tank. As a result of a macroscopic test, there was no dirt on the surface of the steel strip after final cooling.

While, for the purpose of comparing the steel strip was cooled by a conventional immersing manner under the same condition as the above.

Figure 7:
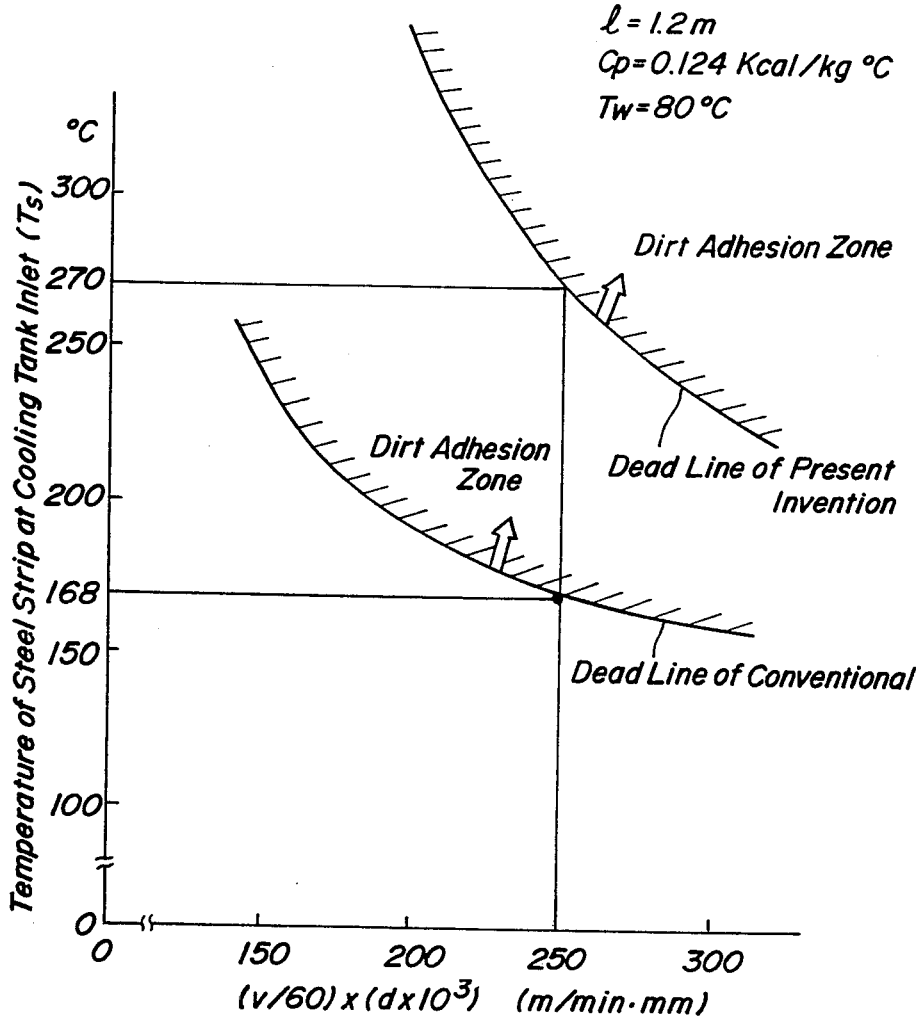
FIG. 7 is a graph showing the dead zone of dirt adhesion.

FIG. 7 is a graph showing the dead zones of dirt adhesion according to the present invention and the conventional manner obtained as a result of the above comparing tests.

It was found from the comparing tests that in order to prevent the dirts from adhering to the surface of the strip, the temperature of the steel strip to be cooled by the conventional manner must be reduced through the cooling zone 16 from 350° C. to 168° C., while the temperature of the steel strip to be cooled according to the present invention is sufficient to reduce from 350° C. to 270° C. through the cooling zone 16.

Figure 8:
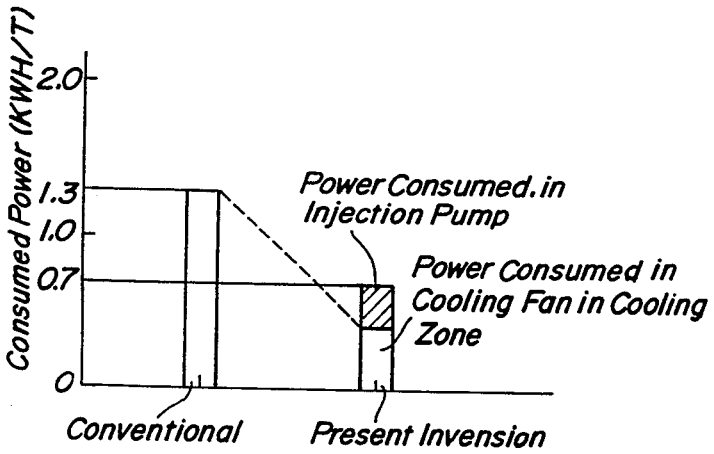
FIG. 8 is a graph showing power consumed in cooling.

It will be seen from FIG. 8 that in accordance with the invention the amount of power consumed in the cooling zone 16 is remarkably reduced and the total amount of power included the power consumed in the injection pump is about 0.7 KWH/T so that the cooling cost can be significantly reduced.

What is claimed is:

1. A method of cooling a steel strip which has been cooled through a final cooling zone in a continuous heat treating line comprising steps of:

immersing the steel strip in cooling water within a cooling tank, passing the steel strip around one or more sink-rolls immersed in the cooling water and injecting cooling water jets to at least one of opposite surfaces of the immersed strip from a plurality of injection nozzles arranged along the immersed strip until the immersed strip reaches the first one of the sink rolls so as to cool the strip to such a low temperature that a water film interposed between the surface of the first sink-roll and the surface of the strip passing around the first sink-roll does not evaporate.

2. The method as claimed in claim 1, wherein the injection of water jets from the injection nozzles is controlled in accordance with the following formula:

$$l \geqq \frac{\rho \cdot Cp \cdot v \cdot d}{2\alpha} \cdot \ln\left(\frac{Ts - Tw}{120 - Tw}\right)$$

here, l is the length of the portion of a steel strip cooled by water jets injected from injection nozzles (m)

Ts is the temperature of the steel strip at the inlet of the cooling tank (°C.)

Tw is the temperature of cooling water (°C.)

Cp is the specific heat of the steel strip (Kcal/kg°C.)

v is the feed speed of the steel strip (m/hr)

d is the thickness of the steel strip (m)

$\alpha$ is the coefficient of heat transfer (8,500~10,500 Kcal/m$^2$hr°C.)

$\rho$ is the density of the steel strip (kg/m$^3$).

* * * * *